US006340660B1

(12) United States Patent
Gastgaber

(10) Patent No.: US 6,340,660 B1
(45) Date of Patent: Jan. 22, 2002

(54) UREA HYDROCHLORIDE STABILIZED SOLVENT FOR CLEANING STAINLESS STEEL AND ALUMINUM

(76) Inventor: Charles Gastgaber, 26 Sunnyside Pl., Woodbridge, NJ (US) 07095

( * ) Notice: Subject to any disclaimer, the term of this patent is extended or adjusted under 35 U.S.C. 154(b) by 0 days.

(21) Appl. No.: 09/814,111

(22) Filed: Mar. 22, 2001

(51) Int. Cl.[7] ..... C11D 1/94; C11D 3/20; C11D 3/30

(52) U.S. Cl. ..... 510/255; 510/245; 510/264; 510/401; 510/422; 510/499

(58) Field of Search ..... 510/245, 255, 510/264, 422, 499, 401; 134/39, 40, 42

(56) References Cited

U.S. PATENT DOCUMENTS 5,672,279 A * 9/1997 Sargent et al. ..... 210/698

6,121,218 A * 9/2000 Thompson ..... 510/176

* cited by examiner

*Primary Examiner*—Gregory Delcotto
(74) *Attorney, Agent, or Firm*—Peter Gibson

(57) ABSTRACT

A water based cleaning solvent primarily containing urea hydrochloride and also containing, in lesser amounts, an amphoteric and/or nonionic surfactant, an ethylamine, and a lesser amount of corrosion inhibitor based upon butyne cleans stainless steel and aluminum surfaces, especially exterior and interior surfaces associated with transportation of both materials, edible and otherwise, and people, most particularly railway transportation comprehensive of both tanks for liquids and other containers for fluent materials, and also including passenger rail cars possessing polycarbonate glazed acrylic windows. This solvent is proposed as a replacement for phosphate based cleaners as an environmentally superior alternative and when used in a conventional pressurized spraying system is effective in obtaining a bright finish on stainless steel and aluminum surfaces with consequent corrosion of neither of these nor polycarbonate surfaces if present.

15 Claims, No Drawings

UREA HYDROCHLORIDE STABILIZED SOLVENT FOR CLEANING STAINLESS STEEL AND ALUMINUM

BACKGROUND OF THE INVENTION

1. Field of the Invention

The present subject matter is related: generally to cleaning compositions for solid surfaces, auxiliary compositions therefor or processes of preparing compositions (Class 510), cleaning compositions or processes of preparing (Subclass 108), for cleaning a specific substrate or removing a specific contaminant (Subclass 109); more particularly to such compositions or processes intended for cleaning bare metal surfaces (Subclass 245); and most specifically to such compositions or processes intended for use on a non ferrous surface further possessing a corrosion inhibiting or solvent stabilizing component (Subclass 255) and such compositions or processes with a corrosion or embrittlement inhibiting component possessing an organic nitrogen containing substituent (Subclass 264).

2. General Background

The present innovation is concerned generally with cleaning railroad cars including the interior metal surfaces of tanks and other containers and the exterior of railroad cars, particularly passenger rail cars which have polycarbonate glazed acrylic windows which are considered a standard in the industry currently. It has been a common practice to use phosphate detergents for this purpose but the use of phosphates has become prohibited by regulation in certain states including New York out of concern for the environmental degradation resulting.

Tanks for holding many liquids, edible and otherwise, and other container type rail cars for transporting fluent materials, edible and otherwise, are commonly manufactured from stainless steel or aluminum. The bodies of passenger rail cars are typically constructed with formed aluminum sheet exteriors with stainless steel fittings. Windows previously made of glass are typically now made of acrylic such as Lexan™ for resistance to fracture glazed with polycarbonate for scratch resistance. Cleaning solutions for passenger rail cars must avoid corrosion of these construction materials.

Discussion of the Prior Art

Urea is an organic nitrogen containing compound, $CO(NH_2)_2$, which has been recognized as a useful stabilizing component for hydrochloric acid, HCl, which has been long recognized as an effective solvent for cleaning many metals including stainless steel, however, the use of urea hydrochloride on aluminum, particularly, often results in blackening of the surface indicative of corrosion. The use of various surfactants including amphoteric and nonionic surfactants and the use of ethylamine, including mono ethanol amine, as an adjunct in small amounts in addition to a water based urea hydrochloride solvent is known but these additives are not effective in preventing corrosion of aluminum surfaces by urea hydrochloride. And no known corrosion inhibitor has been found to be considered satisfactory in preventing this corrosion.

Butylene is recognized, by a dictionary definition, as "any one of three gaseous isometric ethylene hydrocarbons, $C_4H_8$, used principally in making synthetic rubbers". Use of butylene oxide as a solvent stabilizer is known, especially the use of 1,2-butylene oxide, together with nitromethane and 1,3-dioxolane as stabilizers for chlorobromomethane in a solvent mixture "for cleaning articles having hydrocarbon soluble contaminants, especially in a vapor degreaser" (Abstract) as disclosed in U.S. Pat. No. 5,801,136 issued to Henry.

Economic manufacturing means for the production of acetylenedicarboxylic acid, COOHC|CCOOH, more recently known as butynediol, are known. U.S. Pat. No. 4,288,641 issued to Codignol et al. discloses a "process for the preparation of 1,4-butynediol through the reaction of acetylene with formaldehyde in the presence of a catalytic metal, preferably copper" improved by use of a "molecular sieve or synthetic zeolite to which the catalytic metal is chemically bonded through an ion exchange reaction" which increases production rates and prevents formation of acetylene polymer, i.e. cuprene (Abstract).

The use of either butyne or butynediol, however, as a stabilizer or corrosion inhibitor for urea hydrochloride in a solvent for cleaning bare metal is not known in the prior art.

Statement of Need

A need for an environmentally superior alternative to phosphate detergents for the cleaning of bare metal surfaces, particularly stainless steel and aluminum, which will not result in aluminum corrosion and which furthermore will not damage polycarbonate glazed acrylic is recognized. The use of urea hydrochloride, with appropriate surfactants, amphoteric and nonionic, has been recognized as effective on stainless steel but as causing corrosion of aluminum. The addition of ethylamine to such a urea hydrochloride cleaning solution has been recognized as a useful stabilizing agent or adjunct but an effective additive for inhibiting corrosion of aluminum by a urea hydrochloride water based cleaning solvent is unknown and a poignant need for the same is recognized in providing an environmentally superior alternative to phosphate detergents for the cleaning of bare metal surfaces, particularly stainless steel and aluminum, which will not result in aluminum corrosion and which furthermore will not damage polycarbonate glazed acrylic so that the same cleaning solvent may be utilized for all routine rail car cleaning operations including the exterior of passenger cars and the exterior and interior of tanker cars and other container cars used in transporting fluent material edible and otherwise.

SUMMARY OF THE INVENTION

Objects of the Invention

The encompassing object of the present invention is the provision of a cleaning solution effective upon stainless steel and aluminum bare metal surfaces which is environmentally superior to phosphate detergents and which will corrode neither aluminum nor polycarbonate glazed acrylic.

The primary objective of the present invention is to provide a water based urea hydrochloride cleaning solution effective upon stainless steel and aluminum bare metal surfaces which is environmentally superior to phosphate detergents and which will corrode neither aluminum nor polycarbonate glazed acrylic.

An auxiliary objective of the present invention is to inhibit corrosion of aluminum and polycarbonate glazed acrylic by a water based urea hydrochloride cleaning solution effective upon stainless steel and aluminum bare metal surfaces which is environmentally superior to phosphate detergents and which will corrode neither aluminum nor polycarbonate glaze acrylic.

Another auxiliary objective of the present invention is to optimize, with the specification of appropriate substituents, the effectiveness of a water based urea hydrochloride solution in cleaning stainless steel and aluminum bare metal surfaces which is environmentally superior to phosphate detergents and which will corrode neither aluminum nor polycarbonate glazed acrylic.

An ancillary objective of the present invention is the specification of an adjunct stabilizer appropriate for a water based urea hydrochloride cleaning solution effective upon stainless steel and aluminum bare metal surfaces which is environmentally superior to phosphate detergents and which will corrode neither aluminum nor polycarbonate glazed acrylic.

Another ancillary objective of the present invention is the specification of appropriate surfactant for a water based urea hydrochloride cleaning solution effective upon stainless steel and aluminum bare metal surfaces which is environmentally superior to phosphate detergents and which will corrode neither aluminum nor polycarbonate glazed acrylic.

Principles Relating to the Present Invention

In fulfillment of the above state objects it is suggested that corrosion of aluminum and polycarbonate by a water based urea hydrochloride cleaning solution or solvent be prevented by an inhibitor which is compatible, and therefore effective, with urea hydrochloride and further that other compatible solution substituents be identified. For clarity and consistency of language in definition of the present invention urea hydrochloride is considered to comprise the only main constituent to a water based solution or solvent in accordance with the principles relating to the present invention and the other components, aside from the water base, necessarily each comprise separately, and preferably in aggregate, a lesser proportion by volume and are therefore considered substituents.

Three types of substituents are recognized: surfactant, corrosion inhibitor, and an adjunct. Amphoteric and nonionic surfactant is recognized and recommended as a substituent in a cleaning solution in accordance with the principles relating to the present invention. Both types of surfactant are well recognized in and conventional to the prior art. With regard to corrosion inhibition it is recognized that propargyl alcohol, 2-propyn-1-ol, possesses some efficacy in inhibiting corrosion of aluminum by urea hydrochloride but suggested that a chemical relative of butylene, i.e. an ethylene hydrocarbon, be utilized as an inhibitor. Ethylacetylene, i.e. butyne, $CHC{:}CCH_2CH_3$, is specifically recommended as a suitable base for an inhibitor in a water based urea hydrochloride cleaning solution in accordance with the principles relating to the present invention which further contains amphoteric and/or nonionic surfactant and an ethanol amine, ethylamine, as an adjunct.

A water based urea hydrochloride cleaning solution in accordance with the present invention hence possesses urea hydrochloride as the main constituent and possesses as substituents, which by volume comprise a lesser proportion, amphoteric and/or nonionic surfactant, butyne based corrosion inhibitor, and an ethylamine, preferably mono ethanol amine, the adjunct stabilizer considered most compatible. The balance of the cleaning solution is water and it is further specifically suggested that the butyne based inhibitor be based upon acetylenedicarboxylic acid, i.e. butynedioic acid, COOHC:CCOOH, particularly 2-butyne-1,4-diol, i.e. 1,4-butynediol.

DETAILED DESCRIPTION OF THE PREFERRED EMBODIMENT

In accordance with the principles relating to the present invention summarized above a water based urea hydrochloride cleaning solution containing amphoteric and/or nonionic surfactant, a butyne based corrosion inhibitor, and an ethanol amine is suggested for cleaning stainless steel and aluminum surfaces which is corrosive to neither aluminum nor polycarbonate glazed acrylic surfaces. Such a cleaning solution is specifically intended for the cleaning of the interior and exterior of metal tanks and containers including railway tanker cars as well as the exterior of passenger rail cars possessing either glass or polycarbonate glazed acrylic windows which are further typically constructed with formed aluminum sheet exterior surfaces.

It is specifically recommended that such a cleaning solution be comprised, by volume, of between fifteen and seventy per cent urea hydrochloride, two to ten per cent amphoteric surfactant, one to five per cent nine molar nonionic surfactant, one to five per cent ethanol amine, and between one tenth and two per cent of a butyne based corrosion inhibitor, preferably a 1,4-butynediol based corrosion inhibitor which has exhibited the greatest efficacy in the inhibition of corrosion of aluminum by urea hydrochloride as a base in combination with $C_{2n}H_{3n}O_n$ wherein n=2 in the most preferred embodiment. The balance of the composition is water and the resulting cleaning solution has excellent characteristics as a cleaner of both stainless steel and aluminum as well as polycarbonate glazed acrylic without significant corrosion of any of these construction materials.

A cleaning solution comprised of these constituents is considered less destructive environmentally than use of conventional phosphate detergents and these characteristics are considered ideal for a solution which is effective in cleaning the interior and exterior of metal tanks for liquids and other metal containers for fluent materials as well as the exterior of passenger rail cars having aluminum bodies and polycarbonate glazed acrylic windows and hence considered an ideal general purpose cleaning solution for rail cars used in transportation of either materials or people.

In optimization of a water based urea hydrochloride cleaning solution for this purpose in accordance with the principles relating to the present invention it is recommended that the urea hydrochloride comprise approximately fifty per cent by volume, that the substituents including surfactant, adjunct, and inhibitor comprise in aggregate approximately nine per cent by volume, and that water make up the approximately forty-one per cent remaining. The approximate volume percentage of each constituent of what is considered to be the best known or optimal water based urea hydrochloride cleaning solution in accordance with the principles relating to the present invention follows in Table 1 below:

Table 1—Approximate Optimal Composition (a) 50% urea hydrochloride;

(b) 4% amphoteric surfactant;

(c) 2% nine molar nonionic surfactant;

(d) 2% mono ethanol amine;

(e) 1% butyne based inhibitor;

(f) 41% water;

while the range of these constituents considered effective, as mentioned above, is given below in Table 2:

Table 2—Optimal Composition Range (a) 15–70% urea hydrochloride;

(b) 2–10% amphoteric surfactant;

(c) 1–5% nine molar nonionic surfactant;

(d) 1–5% mono ethanol amine;

(e) 0.2–2% butyne based inhibitor;

(f) 8–80.8% water;

wherein the inhibitor is preferably butynediol based, more preferably 1,4-butynediol based, especially as a base in combination with $C_{2n}H_{3n}O_n$ wherein n=2 in the most preferred embodiment.

It is intended, as mentioned earlier, that a water based urea hydrochloride solution in accordance with the principles relating to the present innovation be sprayed with conventional equipment under pressure upon the surfaces to be cleaned. With regard to manufacture of a water based urea hydrochloride solution in accordance with the principles relating to the present innovation no particular technique or apparatus beyond the conventional is necessary. The composition of the water based urea hydrochloride solution in accordance with the principles relating to the present innovation is, therefore, considered essential to fulfillment of said principles. But is also the express intention of the present invention to be utilized as a cleaning solvent for metal surfaces, specifically stainless and aluminum surfaces, and most particularly as a general cleaning solvent for rail transportation vehicles inclusive of tanker cars for liquids, other container cars for fluent material, and passenger cars possessing windows of polycarbonate glazed acrylic.

A range of conventional pressurized spraying systems are known from portable, hand held, nozzles connected by flexible hoses to pressurized containers or reservoir supplied pumps to large, static, structures with a plurality of fixed nozzles located in an interior through which a line of rail cars may be passed and a cleaning solvent or solution in accordance with the principles relating to the present invention may be utilized in any such system. The best known system for the purpose intended is a static structure with an interior open at two opposed ends through which a plurality of serially connected railway carriages, i.e. cars, may be passed, said structure possessing a plurality of nozzles interiorly located and positioned to spray the solvent under pressure in a dispersion impinging all exposed surfaces of the railway cars therein. It is further preferred that two stages be utilized, wash and rinse, wherein spraying of the solvent against the surfaces of the railway cars occurs prior to spraying of water upon these surfaces. The plurality of nozzles utilized in each stage is connected to reservoir supplied pumps. Pressures of over 30 psia, i.e. over 15 psig, are recommended.

The composition defined herein, and preferably utilized in a fixed system as described immediately above, is considered an environmentally superior cleaning solvent for this purpose in comparison with conventionally known phosphate detergents generally while the provision of an effective cleaning solution for the cleaning of bare metal which does not corrode aluminum is considered the broadest benefit enabled by fulfillment of the principles relating to the present invention.

It is further considered that the above is intended to provide one practiced in the art with what is considered to be the best known manner of making and using a preferred embodiment in accordance with the principles relating to the present invention and may in no manner be construed to restrict the scope of either said invention or the rights and privileges secured by letters patent in protection of the same for which I claim:

1. A cleaning composition for bare metal surfaces comprised of:

from 15% to 70% by volume urea hydrochloride, from 3% to 15% by volume of surfactant, from 0.2% to 2% by volume of butyne based corrosion inhibitor, from 1% to 5% by volume of monoethanolamine, the balance being water.

2. A cleaning composition in accordance with claim 1 wherein said surfactant comprises amphoteric surfactant.

3. A cleaning composition in accordance with claim 1 wherein said surfactant comprises nonionic surfactant.

4. A cleaning composition in accordance with claim 3 wherein said nonionic surfactant is nine molar.

5. A cleaning composition in accordance with claim 1 wherein said butyne based corrosion inhibitor is butynediol based.

6. A cleaning composition in accordance with claim 5 wherein said butyne based corrosion inhibitor is based on 1,4-butynediol.

7. A cleaning composition in accordance with claim 5 wherein said butynediol based corrosion inhibitor is compounded with $C_{2n}H_{3n}O_n$.

8. A cleaning composition in accordance with claim 7 wherein n=2.

9. A cleaning composition in accordance with claim 1 containing both amphoteric and nonionic surfactant.

10. A cleaning composition in accordance with claim 9 containing approximately twice as much of said amphoteric surfactant as said nonionic surfactant by volume.

11. A cleaning composition in accordance with claim 10 containing between two and ten per cent amphoteric surfactant by volume and between one and five per cent nonionic surfactant by volume.

12. A cleaning composition in accordance with claim 11 containing approximately four per cent amphoteric surfactant and approximately two per cent nonionic surfactant.

13. A cleaning composition in accordance with claim 1 wherein said butyne based corrosion inhibitor is butynediol based.

14. A cleaning composition in accordance with claim 1 wherein said urea hydrochloride comprises approximately fifty per cent by volume, said surfactant substituent comprises approximately six per cent by volume, said butyne based corrosion inhibitor substituent comprises approximately one per cent by volume, and said monoethanolamine substituent comprises approximately two per cent by volume with the balance of approximately 41% being water.

15. A cleaning composition in accordance with claim 14 wherein said butyne based corrosion inhibitor is butynediol based.

* * * * *